US010531519B2

(12) United States Patent
Vörös

(10) Patent No.: US 10,531,519 B2
(45) Date of Patent: Jan. 7, 2020

(54) ELECTRICAL HEATING DEVICE, METHOD FOR THE PRODUCTION THEREOF, AND VEHICLE SEAT WITH SUCH A HEATING DEVICE

(71) Applicant: GENTHERM GMBH, Odelzhausen (DE)

(72) Inventor: Gábor Vörös, Telki (HU)

(73) Assignee: GENTHERM GMBH, Odelzhausen (DE)

( * ) Notice: Subject to any disclaimer, the term of this patent is extended or adjusted under 35 U.S.C. 154(b) by 775 days.

(21) Appl. No.: 15/098,373

(22) Filed: Apr. 14, 2016

(65) Prior Publication Data

US 2016/0309544 A1 Oct. 20, 2016

(30) Foreign Application Priority Data

Apr. 17, 2015 (DE) ..... 10 2015 004 872

(51) Int. Cl.
*H05B 1/02* (2006.01)

(52) U.S. Cl.
CPC ..... *H05B 1/0238* (2013.01)

(58) Field of Classification Search
CPC .. H05B 1/0238; H05B 3/34; H05B 2203/003; H05B 2203/004; H05B 2203/005; H05B 3/0042; H05B 1/02
(Continued)

(56) References Cited

U.S. PATENT DOCUMENTS 7,134,715 B1 11/2006 Fristedt et al.
8,217,308 B2 * 7/2012 Asami ..... B60N 2/002 219/211
(Continued)

FOREIGN PATENT DOCUMENTS

CN 1906470 A 1/2007
CN 101242757 A 8/2008
(Continued)

OTHER PUBLICATIONS

Chinese First Office Action for Chinese Application No. 201610236450.X; dated Oct. 10, 2017.
(Continued)

*Primary Examiner* — Mark H Paschall
(74) *Attorney, Agent, or Firm* — The Dobrusin Law Firm, P.C.

(57) ABSTRACT

An electrical heating device includes at least one support; at least one ohmic heating resistor; and at least one temperature sensor. The heating resistor includes a heating conductor strand, which is laid out on, or in, the support in a track-like, curving, or meandering pattern to span a heating field. The heating conductor strand includes a measurement loop formed by at least two heating conductor sections that are separated from one another, and, in each case, are connected together electrically conductively at one end, and which are laid out around the temperature sensor and form a delimited measurement field. The temperature sensor is placed in a measurement position within the measurement field spanned by the measurement loop so that it is positioned as a function of a surface area formed by the measurement field at a greater or smaller distance from an opening of the measurement loop.

18 Claims, 3 Drawing Sheets

(58) Field of Classification Search
USPC ..... 219/202, 505, 494, 497, 549, 541
See application file for complete search history.

(56) References Cited

U.S. PATENT DOCUMENTS

| | | | | |
|---|---|---|---|---|
| 8,674,265 | B2 * | 3/2014 | Bode | B60N 2/5685 219/200 |
| 2006/0289460 | A1 | 12/2006 | Thimm et al. | |
| 2007/0215601 | A1 | 9/2007 | Frank | |
| 2008/0093355 | A1 | 4/2008 | Ose et al. | |
| 2008/0142494 | A1 | 6/2008 | Blake et al. | |
| 2009/0008377 | A1 | 1/2009 | Nathan et al. | |
| 2009/0095725 | A1 * | 4/2009 | Ohashi | B60N 2/5685 219/202 |
| 2010/0096379 | A1 | 4/2010 | Asami et al. | |
| 2012/0049586 | A1 * | 3/2012 | Yoshimoto | A47C 7/748 297/180.12 |
| 2012/0217232 | A1 * | 8/2012 | Hermann | B60H 1/2215 219/202 |
| 2013/0327758 | A1 * | 12/2013 | Bauer | B60K 37/06 219/217 |

FOREIGN PATENT DOCUMENTS

| | | | |
|---|---|---|---|
| CN | 101283625 | A | 10/2008 |
| CN | 101663180 | A | 3/2010 |
| CN | 103777661 | A | 5/2014 |
| KR | 20120108597 | A | 10/2012 |

OTHER PUBLICATIONS

Chinese Second Office Action for Chinese Application No. 201610236450.X; dated May 3, 2018.

* cited by examiner

ELECTRICAL HEATING DEVICE, METHOD FOR THE PRODUCTION THEREOF, AND VEHICLE SEAT WITH SUCH A HEATING DEVICE

FIELD

The present invention relates to an electrical heating device, to a seat or vehicle seat with such an electrical heating device, and to a method for the production of such an electrical heating device.

BACKGROUND

In order to increase driver comfort during a car trip, many automobiles are provided with electrical heating devices, in particular with seat heaters. The seat heater is normally formed by heating resistors in the seat area and/or the backrest area of the vehicle seal that comprise a heating conductor strand and form a heating field therefrom. The functionality as well as the reliability of the seat heater are essential quality features here. In order to ensure these quality features, and in order to prevent excessively high heating temperatures, a temperature acquisition is needed. For this purpose, it is possible to install a temperature sensor within two parallel heating conductor strands of the heating field. The temperature sensor is in direct connection with the seat heater control apparatus, which evaluates the temperature measurement values and adapts the heat of the seat heater in a given case. In order to ensure the correctness as well as the quality of the temperature sensor, it is important to put the temperature sensor in the correct position. If the temperature sensor is positioned incorrectly, incorrect temperature measurement values are calculated by the seat heater control apparatus due to the recorded measurement values, which can lead to an undesirable setting of the seat heater temperature. If the temperature is set too high, the seat comfort is decreased due to the heat generated on the vehicle seat. As an additional consequence, overheating of the seat heater can occur, which can trigger dangerous situations such as injury to the driver or ignition of a fire. If an excessively cold temperature of the seat heater is produced, this also leads to reduced driver comfort and in many cases to complaints about the seat heater installation. Moreover, in other application fields of electrical heating devices, the problem of how the temperature can be acquired appropriately within the heating field arises, in order to regulate the heat setting of the heating device.

SUMMARY

The present invention relates to an electrical heating device having the features of claim 1, to a seat or vehicle seat with such an electrical heating device, and to a method for the production of such an electrical heating device. In the electrical heating device, a measurement value is determined by means of at least one temperature sensor within a measurement field delimited by a heating conductor loop, in order to acquire the current temperature of the electrical heating device.

The positioning of the temperature sensor within the heating field is a crucial factor for the accuracy of the measurement values delivered by said temperature sensor.

The primary object of the invention consists in providing an electrical heating device, in which the generation of distorted measurement values of the temperature sensors is to be prevented, in that the placement of the temperature sensor in the area of the heating field is optimized in such a way that the measurement values of the temperature sensor can deliver the truest possible temperature values for the optimal setting of the heating device.

An additional problem consists in providing a method for the production of such an electrical heating device, which improves and simplifies the process of positioning the temperature sensor and which minimizes rejects during the process of production of the electrical heating devices.

The above problem is solved by the subject matters of the independent claims. Additional advantageous designs are described in the respective dependent claims.

It has been found to be essential for the quality of the measurement values of temperature sensors in electrical heating devices according to the preamble to maintain a certain position accuracy during the installation of the temperature sensors. Very narrow tolerances have to be complied with when positioning the sensors, since excessive proximity of the temperature sensor to one of the heating conductor tracks or strands can result directly in a distortion of the delivered measurement values. The same applies in principle in the case of an excessively large distance of the temperature sensor from the heating conductor tracks or heating conductor strands through which current flows. In such cases, the temperature sensor cannot deliver exactly the values that correspond to the actual temperature prevailing in the heating device due to the defined current flow within the heating conductor tracks. Since, in the production and in the laying of the heat conductor strands, tolerances and variations with regard to the course thereof and the dimensional accuracy of individual distances of the tracks from one another can occur, the distances between the usually parallel heat conductor strands, which form respective heat conductor loops, necessarily may also not be constant. Accordingly, it is questionable whether an optimal position of the temperature sensor is achieved, which in principle can constitute a quality problem for all such heating devices. This often results in defective positioning of the temperature sensor. If the separation distance within the heat conductor loop functioning as a measurement loop is too narrow or too broad, this would lead to an excessively high or to an excessively low measurement value of the temperature sensor, which would result in an excessively weak or strong heating of the seat heater. These positioning inaccuracies potentially can cause a high number of rejects in the production of such heating devices, for example, in the production of seat heaters, since many of the heating devices produced would have to be classified as defective.

In order to overcome these mentioned problems, the invention proposes an electrical heating device that consists of at least one support and at least one ohmic heating resistor and that has at least one temperature sensor. The temperature sensor used can be a so-called NTC sensor (Negative Temperature Coefficient Sensor), for example, which is narrowly localized spatially and is therefore suitable for installation within such heating devices at very narrowly defined points. The heating resistor here has at least one heat conductor strand which is laid out on or in the support in a track-like, curving or meandering pattern, in order thereby to span flat heating field that can cover a large area of a seat or backrest surface of a vehicle seat, for example. Moreover, the heating conductor strand comprises at least one measurement loop. The measurement loop is formed by at least two heating conductor sections that are separated from one another and in each case connected together electrically conductively at one end. It should be understood in the present context, the measurement loop is formed by a total of three heating conductor sections connected together that form an opening on a fourth side, since there, in each case, the heating conductor sections are directed away from one another or lead away from one another in a curve-shaped or bent course. These heating conductor sections that have been formed into a measurement loop in this manner are laid out around at least one temperature sensor and as a result they define a delimited measurement field.

The at least one temperature sensor is placed in a certain measurement position within the measurement field spanned by the measurement loop, in such a way that it has approximately the same separation distances from the adjacent heating conductor sections of the measurement loop, and, in addition, it is positioned at a larger or smaller distance from an opening of the measurement loop as a function of a surface area formed by the measurement field. The temperature sensor should as a result be put in a position to deliver electrical measurement values by means of which the current temperatures of the electrical heating device can be determined. The temperature sensor is installed within the measurement field of the heating conductor loop in such a manner that the correlation between the acquired temperature measurement value and the actual temperature averaged over the surface area of the heating field corresponds to an optimum within the mentioned measurement field that is matched to the individual heating device.

The measurement field in which the temperature measurement value is to be determined comprises a surface area of a certain magnitude. The surface area is given here by a defined area within the heating conductor loop in which the temperature sensor is also placed. This area can be limited, for example, by the heating conductor section which precedes the parallel course of the heating conductor strands within the heating conductor loop. As a function of this magnitude, a certain position—in which the temperature sensor should be positioned ideally—in the area of the measurement field is associated with the temperature sensor.

Ideally, within a heating conductor loop, the heating conductor sections extend at least approximately parallel over a certain distance. Nevertheless, it is conceivable that the heating conductor strands that are to constitute the measurement field are arranged in the shape of an arc with the concave arc sides facing one another, form an oval that is open on one side or form a circular segment. Depending on the existing situation, the surface area of the measurement field therefore has to be defined individually.

In the interest of a better reproducibility of the positioning as well as of the subsequently delivered measurement values, the temperature sensor should be installed within the measurement field in such a way that the distance from the heating conductor strands is at least approximately the same on both sides. The distance from the section connecting the heating conductor strands as well as from the opening of the heating conductor strands is in each case variable depending on the surface area of the measurement field. Ideally, the heating conductor sections of the measurement field are arranged at a distance between 5 and 10 mm from one another. However, in the case of a circular or arc-shaped course, the distance can also be greater, and also smaller in individual sections, without negative effect on the operation of the heating device according to the invention.

In laying out the heating conductor strands on or in the support, tolerance indications must be observed in order ideally to produce uniform heating conductor loops. For the ideal positioning of the temperature sensor in one of the heating conductor loops selected as measurement field, the precise course of the parallel heating conductor strands within the heating conductor loop must be known accurately. By the acquisition of the course as well as of the distance between the two parallel heating conductor strands, an ideal fastening position for the temperature sensor can be calculated. This can result in an ideal value for the fastening position of the temperature sensor that varies from one component to another. The acquisition of the course of the heating conductor strands can, for example, be carried out by a camera system or in a similar manner, and the resulting data are subsequently evaluated by an appropriate program and sent to the heating system control device.

In many cases, the temperature sensors have to be introduced manually for reasons pertaining to production technology, i.e., by hand using assembly force. For the positioning of the temperature sensor, certain tolerances are prescribed in this work step. In the case of a required positioning of the temperature sensor within a narrower tolerance limit, a manual installation could be implemented only with great difficulty or it would increase the occurrence of rejects beyond the limits of tolerance due to a possibly defective positioning of the temperature sensor. By determining the actual course of the heating conductor loop and calculating the ideal fastening position of the temperature sensor, this can be avoided, and a broadening of the tolerance limit for the installation of the temperature sensors can be allowed, since, due to the fact that the course of the heating conductor loop is known precisely, the course tolerances thereof do not have to be observed. An ideal fastening point, according to the calculation thereof, for example, can be indicated by means of a light spot generated by a laser pointer or in a similar manner, which can be used as reference point during the manual positioning of the temperature sensor. In this way, a simpler, quicker and more economic positioning process can be provided. After the optionally manual fastening process, the actual position of the temperature sensor can be acquired and the correctness of the fastening position can be checked, in order to screen out defective heating devices.

On the one hand, this procedure minimizes the occurrence of rejects, and, in addition, due to the ideal positioning of the temperature sensor, a more uniform surface temperature for the individual electrical heating devices can be ensured. For a more precise monitoring of the temperature of the individual electrical heating device, it is also conceivable to install several temperature sensors in different heating conductor loops.

For example, the electrical heating device according to the invention can be integrated in a vehicle seat, in particular in the seat pad thereof and/or in the backrest pad thereof.

As an additional part of the invention, a method for producing an electrical heating device according to the invention can be provided. For this purpose, in a heating field, at least one heating conductor strand is curved at least in sections, deflected repeatedly and/or arranged in a meandering pattern at least in sections. The magnitude of the surface area between two directly adjacent heating conductor strands that form a measurement field is then acquired. As a function of this acquired magnitude, the temperature sensor is fixed in a position defined thereby within the measurement field. As desired, the exact course of the heating conductor strands forming the heating conductor loop can be acquired by a camera system. In addition, it can also be appropriate, during the further installation of the temperature sensor, to indicate the target position thereof within the measurement field by means of a light spot, in particular by means of a laser pointer, which gives a manual, partially automatic or automatic positioning of the temperature sensor.

Below, embodiment examples of the invention and the advantages thereof will be explained in further detail in reference to the appended figures. The size ratios of the individual elements with respect to one another in the figures do not always correspond to the real size ratios, since some shapes are represented in a simplified manner and other shapes are represented enlarged relative to the other elements to improve the illustration.

DETAILED DESCRIPTION

This application claims priority to and the benefit of German Application DE102015004872.4, filed on Apr. 17, 2015, the disclosure of which is hereby incorporated by reference herein in its entirety for all purposes.

Figure 1:
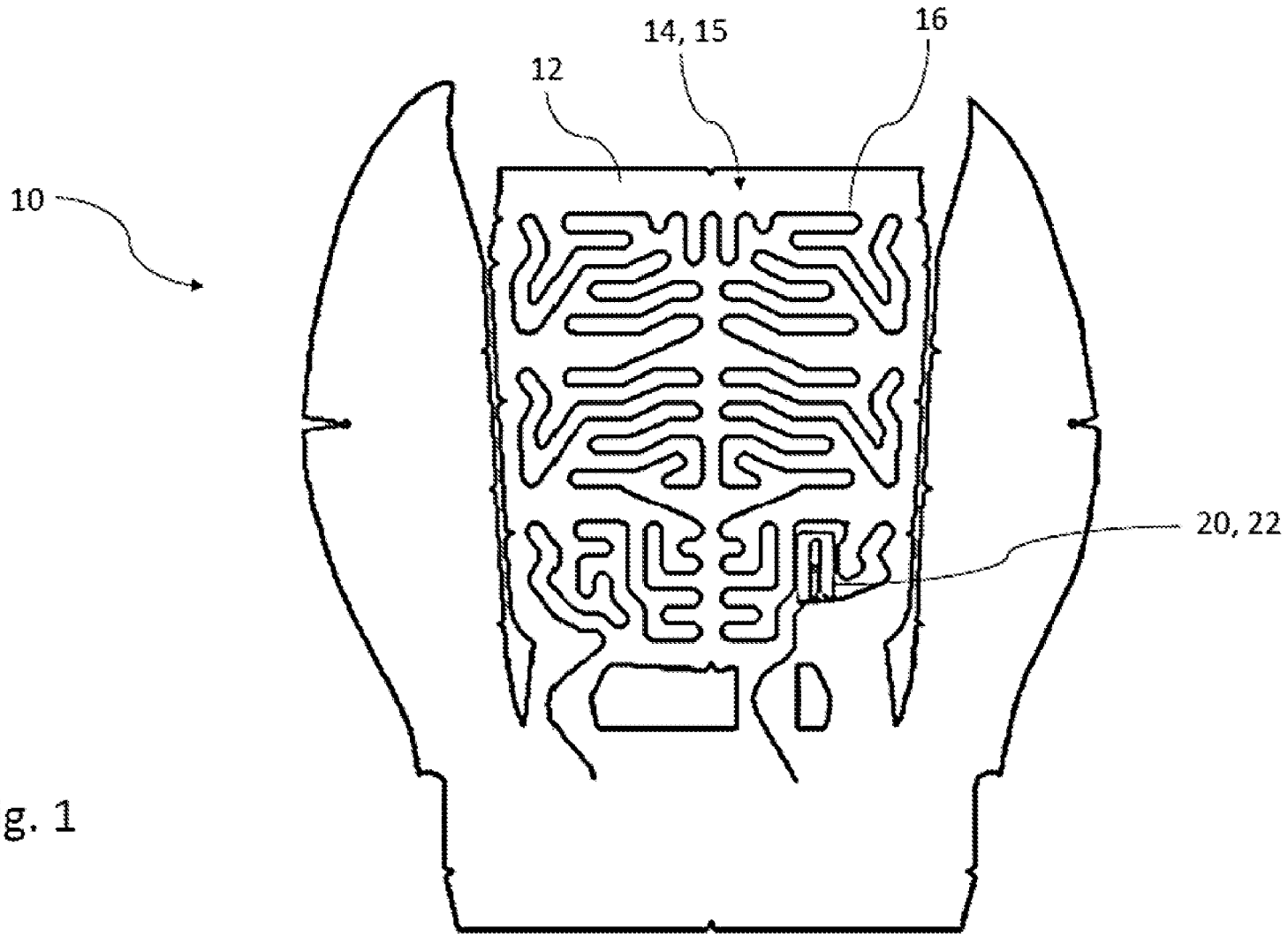
FIG. 1 shows a diagrammatic top view of an embodiment variant of an electrical heating device according to the invention.
Figure 2A:
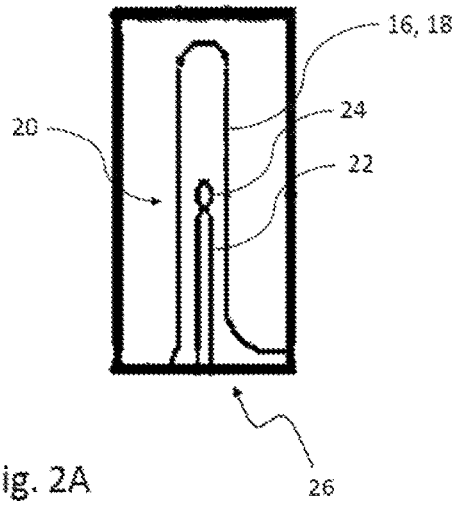
FIG. 2A shows an enlarged section of a detail from FIG. 1.

In the diagrammatic representation of FIG. 1, a seat area of a vehicle seat 10 is indicated. In the inside area, in a support 12 which forms an inner seat area, an electrical heating device 14 in the form of a seat heater 15 is installed. The electrical heating device 14 forming the seat heater 15 is spanned by a plurality of heating conductor strands 16 connected together. For an ideal operation, the heating conductor strands 16 form so-called heating conductor loops 18. At least one of these heating conductor loops 18 is used as measurement loop in which a measurement field 20 is spanned. In the measurement field 20, a temperature sensor 22 is to be placed, which is in the form of an NTC sensor comprising an NTC sensor head 24 on which the temperatures within the seat heater 15 are measured. This can be seen in the enlarged representation in FIG. 2A.

Figure 2B:
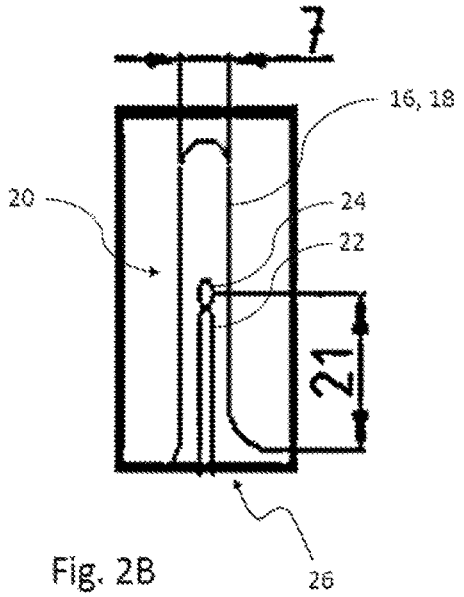
FIG. 2B shows a detailed view of a placement of a temperature sensor.

Ideally, the heating conductor loop 18 is spanned by parallel heating conductor strands 16 at a separation distance of approximately 7 mm for example, as represented in FIG. 2B. A camera system that is not shown acquires the exact course of the heating conductor strands 16 and calculates via software an ideal fastening position for the installation of the temperature sensor 22 or of NTC sensor. The NTC sensor head 24, in the case of this acquired separation distance of the heating conductor strands 16 of 7 mm, is ideally placed at a depth of 21 mm in the measurement field 20, measured from the opening 26 of the heating conductor loop 18, which is located in each case at the bottom in the representations of FIGS. 2A-2D. By means of the spot of a laser pointer, this fastening position is represented as a reference point for the attachment of the temperature sensor 22 or NTC sensor. The temperature sensor 22 or NTC sensor can subsequently be manually attached rapidly and simply, and is ideally positioned in the measurement field 20 in order to acquire temperature measurement values by means of which the actual temperature of the seat heater 15 can be calculated. In this manner, an ideal setting of the temperature of the seat heater 15 is made possible.

Figure 2C:
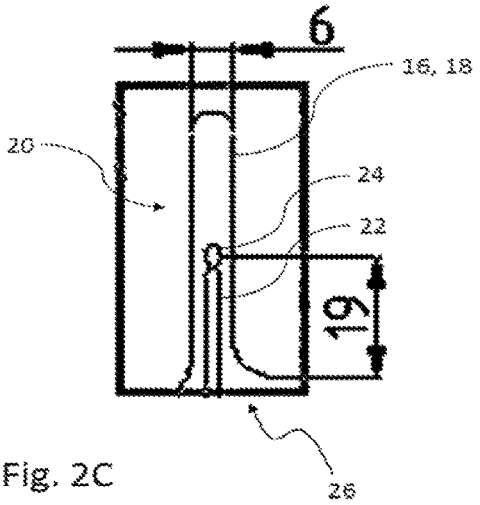
FIG. 2C shows an additional detailed view of a placement of the temperature sensor.

FIG. 2C represents another possible case. Here, the separation distance of the parallel heating conductor strands 16 in the heating conductor loop 18 is only 6 mm. The camera system again acquires the exact course of the heating conductor strands 16 and calculates the ideal fastening position for the attachment of the NTC sensor 22, which comprises the NTC sensor head 24 which is now located at a depth of 19 mm in the measurement field 20, measured again from the lower opening 26 of the loop 18. As a result of this procedure, it is ensured, in spite of the smaller heating conductor loop 18, that the NTC sensor 22 is uniformly heated by the heating conductor strands 16, as in the ideal case described in FIG. 2B. As a result, an incorrect calculation of the actual temperature of the seat heater 15 is avoided.

Figure 2D:
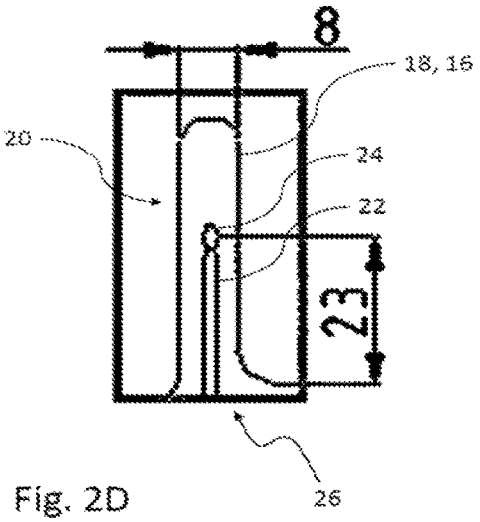
FIG. 2D shows an additional detailed view of the placement of the temperature sensor.

FIG. 2D shows a case in which the separation distance of the parallel heating conductor strands 16 in the heating conductor loop 18 assumes a value of 8 mm, for example, which is thus greater than in the ideal case. After the camera system has acquired the exact course of the heating conductor strands 16, the result is an ideal fastening position for the attachment of the NTC sensor 22 of 23 mm in the measurement field 20, measured from the lower opening 26 of the loop 18. Thus, in this case as well, an ideal heating—described in FIG. 2B—of the NTC sensor 22 is ensured.

Figure 3:
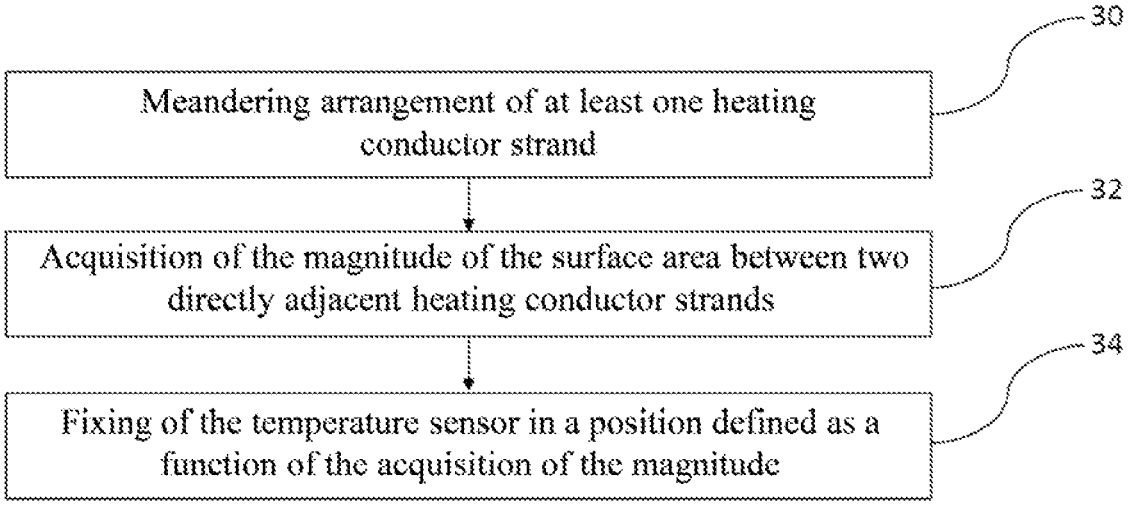
FIG. 3 shows a chart of the method to illustrate the required method steps in the production of the electrical heating device.

FIG. 3 shows a chart of the method for illustrating the method of production of the electrical heating device 14 according to the invention. In the first step 30, the method comprises a process in which at least one heating conductor strand 16 is laid out in a meandering arrangement. Subsequently, in the following step 32, the magnitude of surface area between two directly adjacent heating conductor strands is acquired. In the third step 34, the temperature sensor 22 is fixed in a defined position, which has been determined as a function of the acquired magnitude.

The invention has been described in reference to a preferred embodiment. However, it is conceivable to a person skilled in the art that deviations or changes can be made to the invention without thereby leaving the scope of protection of the following claims.

LIST OF REFERENCE NUMBERS

10 Vehicle seat
12 Support
14 Electrical heating device
15 Seat heater
16 Heating conductor strand
18 Heating conductor loop
20 Measurement field
22 Temperature sensor, NTC sensor
24 NTC sensor head
26 Opening
30 Step 1
32 Step 2
34 Step 3

I claim:

1. An electrical heating device comprising:

a. at least one support;

b. at least one ohmic heating resistor; and c. at least one temperature sensor;

wherein the at least one ohmic heating resistor comprises at least one heating conductor strand, the at least one heating conductor strand is laid out on, or in, the at least one support in a track-like, curving, or meandering pattern in order to span a heating field, wherein the at least one heating conductor strand comprises at least one measurement loop, which is formed by two straight heating conductor strand sections that are separated from one another and connected together electrically conductively at one end, the two straight heating conductor strand sections are laid out around the at least one temperature sensor and thereby form a delimited measurement field, wherein the at least one temperature sensor is placed in a measurement position within the delimited measurement field spanned by the at least one measurement loop in such a way that the at least one temperature sensor:

i. has approximately a same distance from the two straight heating conductor strand sections of the at least one measurement loop, and ii. is positioned within the at least one measurement loop as a function of a surface area formed by the delimited measurement field.

2. The electrical heating device according to claim 1, wherein the delimited measurement field spans the surface area having a defined magnitude, and wherein depending on the defined magnitude of the surface area of the delimited measurement field, a certain position in the surface area of the delimited measurement field is associated with the at least one temperature sensor.

3. The electrical heating device according to claim 1, wherein the at least one temperature sensor is arranged approximately equidistantly between the two straight heating conductor strand sections, and wherein a distance from a section connecting the two straight heating conductor strand sections or from an opening formed between the two straight heating conductor strand sections is a function of the surface area of the delimited measurement field.

4. The electrical heating device according to claim 1, wherein the two straight heating conductor strand sections that form the delimited measurement field are oriented at least approximately parallel to one another or parallel to one another in at least some sections.

5. The electrical heating device according to claim 1, wherein the two straight heating conductor strand sections that form the delimited measurement field are arranged at a distance which is between 4 mm and 10 mm from one another.

6. The electrical heating device according to claim 1, wherein the at least one temperature sensor is formed as an NTC sensor which is narrowly localized spatially.

7. The electrical heating device according to claim 1, wherein the at least one heating conductor strand and/or the at least one temperature sensor is/are sewn into the at least one support.

8. The electrical heating device according to claim 1, wherein the at least one temperature sensor comprises a plurality of temperature sensors that are attached in two or more positions within the electrical heating device.

9. The electrical heating device according to according to claim 1, wherein a correlation between a temperature measurement value delivered by the at least one temperature sensor and an actual temperature averaged over the surface area of the heating field corresponds to the delimited measurement field that is matched to an individual heating device.

10. A heatable vehicle seat having a seat pad and/or a backrest pad, wherein at least the seat pad and/or the backrest pad is/are provided with the electrical heating device according to claim 1 which forms a seat heater of the vehicle seat.

11. A method for production of the electrical heating device according to claim 1 comprising:

arranging the at least one heating conductor strand in a curving or meandering pattern in at least some sections; and acquiring a magnitude of a distance and/or a surface area between the two straight heating conductor strands that form the delimited measurement field; and fixing the at least one temperature sensor in a defined position within the delimited measurement field as a function of the acquired magnitude.

12. The method according to claim 11, wherein the method includes a step of acquiring by means of a camera system, an exact pattern of the two straight heating conductor strand sections forming the heating conductor loop.

13. The method according to claim 11 wherein a target position of the at least one temperature sensor within the delimited measurement field is indicated by means of a light spot, in particular, by means of a laser pointer, which gives a manual, partially automatic or automatic positioning of the at least one temperature sensor within the electrical heating device.

14. The electrical heating device according to claim 1, wherein the at least one measurement loop has a parabolic shape.

15. The electrical heating device according to claim 1, wherein the two straight heating conductor strand sections are spaced apart by a distance of 7 mm, and a sensor head of the at least one temperature sensor is placed at a depth of 21 mm from the opening of the at least one measurement loop.

16. The electrical heating device according to claim 1, wherein the two straight heating conductor strand sections are spaced apart by a distance of 6 mm, and a sensor head of the at least one temperature sensor is placed at a depth of 19 mm from the opening of the at least one measurement loop.

17. The electrical heating device according to claim 1, wherein the two straight heating conductor strand sections are spaced apart by a distance of 8 mm, and a sensor head of the at least one temperature sensor is placed at a depth of 23 mm from the opening of the at least one measurement loop.

18. An electrical heating device comprising:

a. at least one support;

b. at least one ohmic heating resistor; and c. at least one temperature sensor;

wherein the at least one ohmic heating resistor comprises at least one heating conductor strand, the at least one heating conductor strand is laid out on or in the at least one support in a track-like, curving or meandering pattern in order to span a heating field, wherein the at least one heating conductor strand comprises at least one measurement loop, which is formed by at least two straight heating conductor strand sections that are separated from one another and connected together electrically conductively at one end, and which are laid out around the at least one temperature sensor and thereby form a delimited measurement field, wherein the at least one temperature sensor is placed in a measurement position within the delimited measurement field spanned by the at least one measurement loop in such a way that the at least one temperature sensor:

i. has approximately same distances between the at least two straight heating conductor strand sections of the at least one measurement loop, and ii. as a function of a surface area formed by the delimited measurement field, the at least one temperature sensor is positioned at a larger distance from an opening of the at least one measurement loop, wherein a distance from a section connecting the at least two straight heating conductor strand sections or from an opening formed between the at least two straight heating conductor strand sections is variable as a function of the surface area of the delimited measurement field, wherein the at least two straight heating conductor strand sections that form the delimited measurement field are oriented at least approximately parallel to one another or parallel to one another in at least some sections, wherein sections of the at least two straight heating conductor strand sections that form the delimited measurement field are arranged at a distance between 6 mm and 8 mm from one another, wherein the at least one heating conductor strand and/or the at least one temperature sensor, is/are sewn into the at least one support, and wherein a correlation between a temperature measurement value delivered by the at least one temperature sensor and an actual temperature averaged over the surface area of the heating field corresponds to an individual electrical heating device.

* * * * *